United States Patent [19]

Brooks

[11] 4,166,739

[45] Sep. 4, 1979

[54] QUARTERNARY β-BRASS TYPE ALLOYS CAPABLE OF BEING RENDERED HEAT RECOVERABLE

[75] Inventor: Peter L. Brooks, Palo Alto, Calif.

[73] Assignee: Raychem Corporation, Menlo Park, Calif.

[21] Appl. No.: 797,621

[22] Filed: May 17, 1977

Related U.S. Application Data

[63] Continuation of Ser. No. 668,040, Mar. 18, 1976, abandoned.

[51] Int. Cl.[2] ..... C22C 9/04

[52] U.S. Cl. ..... 75/157.5; 148/11.5 C

[58] Field of Search ..... 148/2, 11.5 R, 11.5 C, 148/32, 160; 75/157.5

[56] References Cited

U.S. PATENT DOCUMENTS

| | | | |
|---|---|---|---|
| 2,085,416 | 6/1937 | Corson | 75/157.5 |
| 3,783,037 | 1/1974 | Brook et al. | 148/11.5 R |
| 4,036,669 | 7/1977 | Brook et al. | 148/11.5 C |

*Primary Examiner*—L. Dewayne Rutledge
*Assistant Examiner*—Peter K. Skiff
*Attorney, Agent, or Firm*—Lyon & Lyon

[57] ABSTRACT

Alloys comprising by weight 70–82% Copper, 6–10% Aluminum, 0.1–24% Zinc and 0.1–12% Manganese are particularly suited for use as the material of heat recoverable articles as they exhibit good ductility and stability and are easily worked by hot working techniques. Additionally, they have $M_s$ temperatures which enables them to be fabricated into heat recoverable articles useful in many applications.

A heat recoverable article, made from a quarternary alloy of copper, aluminum, manganese and zinc whose composition falls on or near the eutectoid line, is particularly suited for use in circumstances where the article has been recovered from its recoverable state under conditions such that a degree of unresolved recovery remains.

16 Claims, 6 Drawing Figures

50
45
40
35
30
25
20
15
10
5
0
5
10
15
WEIGHT % ZINC
WEIGHT % ALUMINUM
X
Y
TRACE OF EUTECTOID
MS
-200c
-125c
-50c
+25c

QUARTERNARY β-BRASS TYPE ALLOYS CAPABLE OF BEING RENDERED HEAT RECOVERABLE

This is a continuation of application Ser. No. 668,040, filed Mar. 18, 1976, abandoned.

FIELD OF THE INVENTION

This invention relates to metal alloys capable of being rendered heat recoverable. In another aspect, it relates to heat recoverable metal articles.

CROSS-REFERENCE TO RELATED APPLICATIONS

This application is related to, and incorporates by reference, my concurrently filed applications, "Stable Heat Recoverable Ternary β-Brass Type Alloys Containing Manganese" having Ser. No. 668,028, abandoned, and "Stable Heat Recoverable Ternary β-Brass Alloys Containing Aluminum" having Ser. No. 668,041, abandoned.

BACKGROUND OF THE INVENTION

Materials, both organic and metallic, capable of being rendered heat recoverable are well known. An article made from such materials can be deformed from an original, heat-stable configuration to a second, heat-unstable configuration. The article is said to be heat recoverable for the reason that, upon the application of heat, it can be caused to revert from its heat-unstable configuration to its original, heat-stable configuration.

Among metals, for example certain alloys of titanium and nickel, the ability to be rendered heat recoverable is a result of the fact that the metal undergoes a reversible transformation from an austenitic state to a martensitic state with changes in temperature. An article made from such a metal, for example a hollow sleeve, is easily deformed from its original configuration to a new configuration when cooled below the temperature at which the metal is transformed from the austenitic state to the martensitic state. This temperature, or temperature range, is usually referred to as the $M_s$ temperature. When an article thus deformed is warmed to the temperature at which the metal reverts back to austenite, referred to as the $A_s$ temperature or range, the deformed object will revert to its original configuration. Thus, when the hollow sleeve referred to above is cooled to a temperature at which the metal becomes martensitic, it can be easily expanded to a larger diameter, for example, by using a mandrel. If the expanded sleeve is subsequently allowed to warm to the temperature at which the metal reverts back to its austenitic state, the sleeve will revert to its original dimensions.

Ordinarily, such a sleeve would recover all or substantially all of the deformation, i.e., it would revert completely to its original dimensions. However, it should be noted that under certain circumstances the article might be deformed to such an extent that all of the deformation cannot be recovered on heating. Alternatively, if something, e.g., an intervening rigid substrate having a greater external dimension than the internal pre-deformation dimensions of the sleeve is interposed within the sleeve, the sleeve cannot recover to its original dimensions. Any dimensional change up to the maximum available which an article can recover absent any intervening substrate is called the heat recoverable strain. That portion of the heat recoverable strain which an intervening substrate or other agency precludes recovery of, is referred to as unresolved recovery. Finally, any deformation which exceeds the maximum available heat recoverable strain is said to effect non-recoverable strain.

That the titanium nickel alloys referred to above possess the property of heat recoverability has been known for many years. More recently, Brook et al, for example in U.S. Pat. No. 3,783,037, the disclosure of which is incorporated by reference, have disclosed a method for producing a heat recoverable article in which an alloy comprising an inter-metallic compound that undergoes a diffusionless transformation into a banded martensite upon cooling with or without working is deformed after appropriate heat treatment. On reheating the article, it at least partly resumes its original shape. The alloys preferred by Brook et al are copper based alloys which transform into a martensite of pseudo-cubic symmetry. The preferred alloys include the binary copper-zinc and copper-aluminum systems and the ternary copper-aluminum-zinc, copper-aluminum-tin, copper-zinc-silicon, copper-aluminum-manganese, copper-aluminum-iron and copper-aluminum-nickel systems.

In U.S. Pat. No. 3,783,037 (Col. 8, ln. 63 et seq.) Brook et al note in respect to the copper-aluminum-zinc system that ". . . as there is progressive increase in the aluminum content and decrease in the zinc content . . . , the maximum ductility that can be produced in the ternary alloys when deformed at or near the $M_s$ decreases." They further note that as the aluminum level increases, the maximum obtainable heat recoverable strain decreases. For example, in alloys of the compositions (by weight) 72% copper, 22% zinc and 6% aluminum and 75.7% copper, 17% zinc and 7.5% aluminum, the maximum heat recoverable strain was reported to be 4.8% and 4.0%, respectively.

The clear teaching of this patent is therefore that the aluminum content of the alloy should be reduced as much as possible to achieve enhanced heat recoverable strain. Unfortunately, I have found that, unknown to the prior art, reducing the aluminum content has a severe adverse effect on the stability of the article under conditions of unresolved recovery. Additionally, if one follows the teaching of the prior art and avoids ternary alloys containing significant quantities of aluminum, limitations are encountered in hot working. In particular, low energy input hot working requires avoidance of a second phase in the structure. Unfortunately, low aluminum content alloys must be maintained at very high temperatures, e.g., at least in excess of 650° C., to be in the one-phase beta condition. At such high temperatures, tool life is shortened and the avoidance of coarse grain size in the product is very difficult.

If a heat recoverable article is recovered onto a substrate such that the substrate prevents full recovery of the article to its original configuration, i.e., under conditions of unresolved recovery, then the residual strain results in a stress in the article. I have now discovered that all copper alloy compositions having the β-brass structure are more or less unstable if complete recovery is prevented. Thus, I find that at moderate temperatures such as would typically be seen during service, for example, in hydraulic or electrical applications in aircraft, the residual stress in incompletely recovered articles will decay steadily to zero such that after a certain period of time the recovered object, for example, a sleeve recovered about a substrate, can be easily removed from the substrate.

Inasmuch as heat recoverable metals find their greatest utility in applications where they exert a high degree of compressive or other form of stress, it will be readily recognized by those skilled in the art that the stress relaxation process described above is a considerable impediment to the wide spread use of these metals. For example, parts made from the binary alloys and the specific ternary alloys described in the Brook et al patent mentioned above, when prevented from recovering completely to an initial configuration under conditions of about 4.0% unresolved recovery, exhibit complete stress relaxation at 125° C. in less than 1,000 hours (equivalent to within 100 hours at 150° C.) so that they are essentially useless in many applications.

In the aforementioned patent, Brook et al also describe a process they term "reversible heat recoverable strain" in a copper-zinc-tin alloy which had an $M_s$ of −70° C. A sample of this alloy was quenched from 800° C., deformed below its $M_s$ and allowed to recover by heating above its $A_s$. It was noted that there was partial recovery of the strain that had been induced in the alloy by its deformation as it was heated into the range in which the alloy reverted to its austenitic state. On further heating to 250° C., the specimen suprisingly changed shape by immediately moving back toward the deformed configuration. This alloy was considered by them to be unique in this regard. I have found that this phenomenon of reverse recovery is by no means unique to the particular alloy reported but is, in fact, prevalent among many of the reported prior art compositions. Such phenomenon is merely a particularly severe manifestation of the unresolved recovery induced instability (stress relaxation) hereinafter discussed in greater detail, i.e., a loss of stress even under zero restraining force. Needless to say, none of my instantly claimed alloys manifest such a phenomenon.

Therefore, although a wide variety of β-brass type copper alloy compositions capable of being rendered heat recoverable are known to the prior art, those compositions possess serious shortcomings severely limiting their use.

Accordingly, one object of this invention is to provide improved β-brass type alloys.

Another object of this invention is to provide heat recoverable articles of β-brass type alloys that will exhibit long term stress stability when recovered under conditions so that a level of unresolved recovery remains.

Yet another object of this invention is to provide heat recoverable articles of β-brass type alloys that will maintain a stress for greater than 1,000 hours at 125° C. or for greater than 100 hours at 150° C.

SUMMARY OF THE INVENTION

According to the present invention, there is provided quarternary alloys of copper, aluminum, zinc and manganese that are capable of being rendered heat recoverable. Preferred alloys are those comprising, by weight, 70–82% Copper, 6–10% Aluminum, 0.1–24% Zinc and 0.1–12% Manganese. In the preferred range, the alloys are highly ductile and easily worked by hot working techniques.

Heat recoverable articles made from these alloys exhibit long term stress stability even when recovered under circumstances that a level of unresolved recovery remains.

DETAILED DESCRIPTION OF THE INVENTION

As previously discussed in the Background of the Invention, I have unexpectedly discovered that articles formed from the β-brass type compositions known to the prior art suffer the serious disadvantage of being unstable with respect to the maintenance of stress when the article has been exposed to modestly elevated temperatures for extended periods of time under conditions of unresolved recovery. This phenomenon manifests itself in actual use situations when an article made from such an alloy is deformed when in its martensitic state to thereby render it heat recoverable, and then allowed to recover by warming it to a temperature at which the alloy reverts to austenite in a manner that precludes the article from completely recovering to its original configuration and thereafter exposed to temperatures above about 80° C. That portion of the strain which remains in the article after this partial recovery is, as above indicated, referred to as unresolved recovery.

In my concurrently filed applications, hereinabove incorporated by reference, there is disclosed my discovery that articles made from β-brass type compositions known to the prior art are unstable with respect to maintaining adequate stress levels, i.e., the stress gradually decays to zero. The rate of decay increases with temperature.

Also, they describe my discovery that, for copper, aluminum and zinc and copper, aluminum and manganese alloys, the tendency towards stress instability is composition dependent and that the most stable alloys are those lying on or near the eutectoid line.

Figure 1:
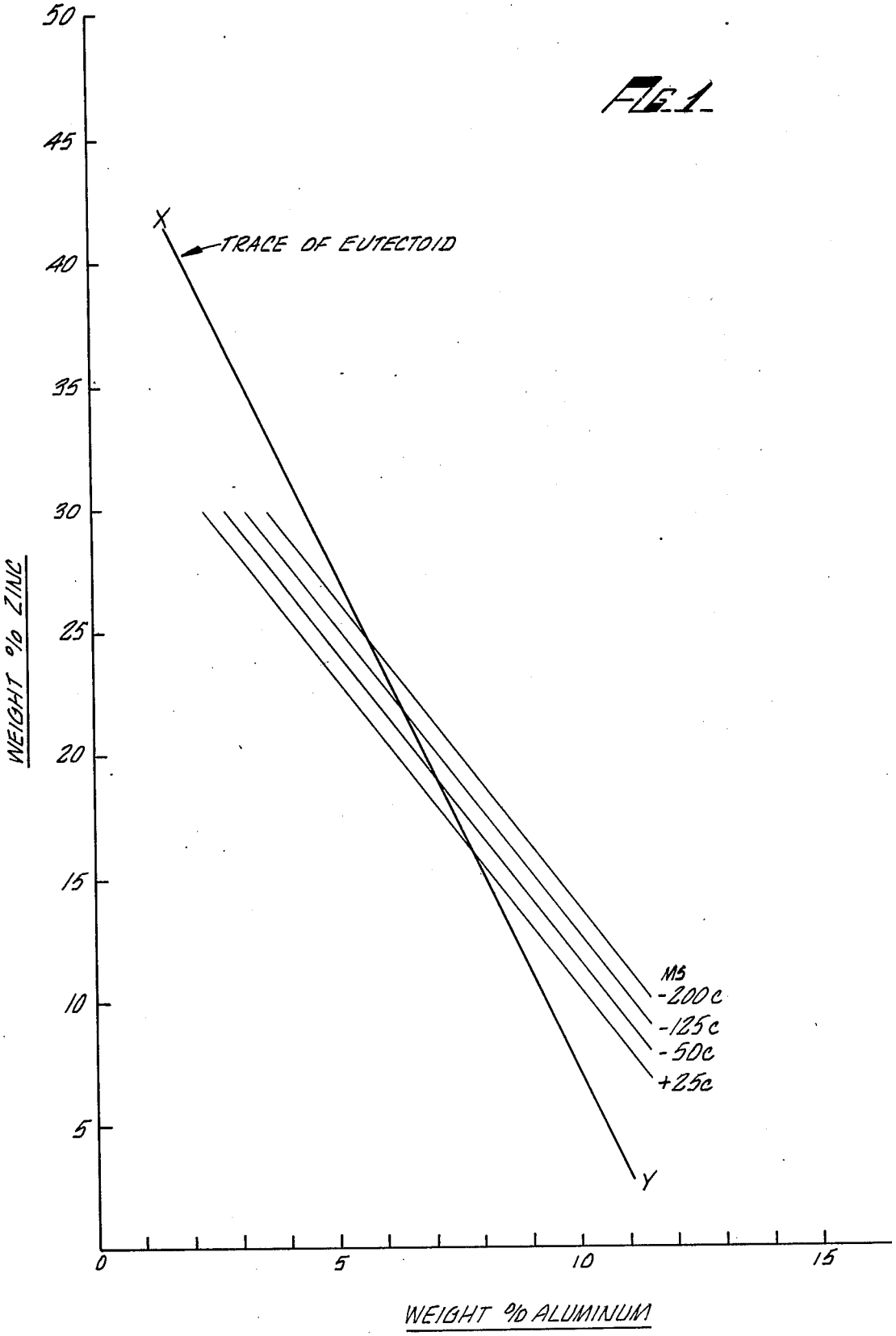
FIG. 1 is a graph showing the relationship between the eutectoid line for ternary copper-aluminum-zinc alloys and $M_s$ temperature.

Referring now to FIG. 1, there is graphically illustrated the eutectoid line XY for alloys of copper, aluminum and zinc. Also plotted on this graph are lines which correspond to compositions of equal $M_s$ temperatures for $M_s$ temperatures of −200° C., −125° C., −50° C. and +25° C. and their junction with the eutectoid line. Thus, for example, the $M_s$ line for compositions of $M_s$=−50° C. intersects the eutectoid line at 7% Al, 19.2% Zn.

There are certain practical consequences which limit the usefulness of the ternary alloys discovered by me. Firstly, in the Cu-Al-Zn ternary system, the composition range of maximum stability lies on or very near the eutectoid line even though the stability of the eutectoid composition can be equalled by moving into the gamma rich region, i.e., by increasing the aluminum content. However, as the alloy composition is moved into the gamma rich region, hot working and annealing at undesireably high temperatures become necessary to avoid significant precipitation of the gamma phase with concommitant embrittlement.

Secondly, in the case of Cu-Al-Mn ternary alloys, there is a level of stability which cannot be improved upon for any $M_s$ temperature. However, because of the high aluminum content of the alloys which give the best stability, they may not be ductile enough for the desired use.

By the present invention, the shortcomings inherent in the ternary alloys described in my copending applications are overcome by incorporating a fourth metal in the alloys, zinc in the case of copper-aluminum-manganese alloys and manganese in the case of copper-aluminum-zinc alloys. This provides alloys capable of being rendered heat recoverable in which the stability, ductility and $M_s$ can be optimised to meet the desired application. Thus, by virtue of the degree of freedom offered by the fourth metal, for each desired $M_s$ temperature there is a nearly infinite number of eutectoid compositions. This is shown by way of exemplification of FIG. 2 where there is plotted the eutectoid compositions for alloys having an $M_s$ of $-50°$ C. as a function of the manganese and aluminum concentration. The zinc concentration along this eutectoidal line also varies and may be estimated from equations (b), (c), or (d) shown infra.

Another unexpected benefit of the use of these quarternary alloys is that the great majority of the alloys described herein do not form the $\alpha$ or $\gamma$ phase until cooled to temperatures of 550° C. or even lower. By contrast, many of the unstable alloys contemplated by the prior art form the $\alpha$ or $\gamma$ phase even at temperatures in excess of 650° C. Thus the quarternary alloys of the instant invention may advantageously be worked in the $\beta$-phase field at much lower temperatures than those of the prior art with the consequence of greatly improved tool life. Yet another unexpected benefit of these alloys is that the kinetics of formation of the $\alpha$ and $\gamma$ phase is very significantly retarded when compared with prior art compositions. Thus in the majority of the alloys of the instant invention, air cooling is sufficiently rapid to retain substantially all the material in the $\beta$-phase. A highly beneficial result of this is that the warpage which results from rapid quenching (as when using water as the quenchant) and variations in quenching rate across relatively thick sections (with a concommitant variation in phase composition) can be avoided. The improvements obtained by the addition of combinations of either Mn or Zn, with other metals or pairs of other metals, to mixtures of Cu and Al, are minor when compared with the benefits accruing from the addition of Mn and Zn in combination.

Figure 2:
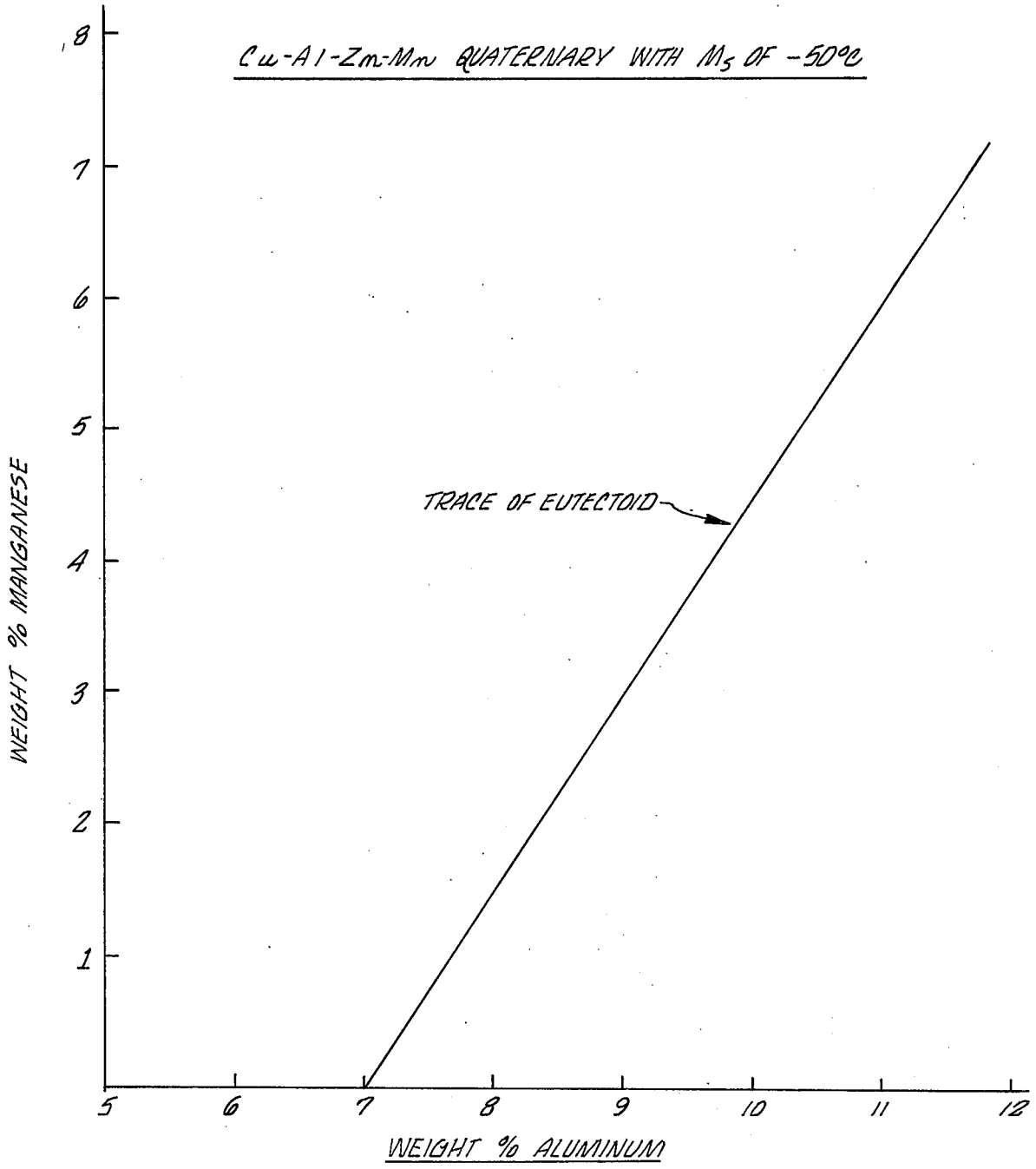
FIG. 2 is a graph of the eutectoid line of copper-aluminum-zinc-manganese alloys having a $M_s$ of −50° C.

A consideration of FIG. 2 will show that the eutectoid composition for an $M_s$ of $-50°$ C. can be varied by substituting manganese for zinc (but not on an equal weight basis). For this reason, the aluminum content of the alloys can be increased with a corresponding increase in stability.

I have found that the stress stability of these quarternary alloys of this invention are influenced by:

1: The position of the composition relative to the eutectoid;

2: The $M_s$ temperature;

3: The aluminum content of the alloy.

The influence of these factors was found from the following experimental procedure. Each alloy was quenched into water at 20° C. from 650° C. A 3" long sample was cooled to below the $M_s$ temperature for the alloy and deformed 4.25% by being bent into a U shape about a rod. The sample was heated to either 125° C. or 150° C. while being held in the deformed shape. Periodically the specimen was cooled to room temperature and the constraint was then removed. When this was done, the amount of springback, i.e., movement toward the original configuration, was measured. The specimen was then replaced in the constraint and held for a further period of time at either 125° C. or 150° C. When upon removal of the constraint no springback was observed, the time that it took to reach that condition was taken as the stability limit. This is the time that is given in the table.

Figure 3:
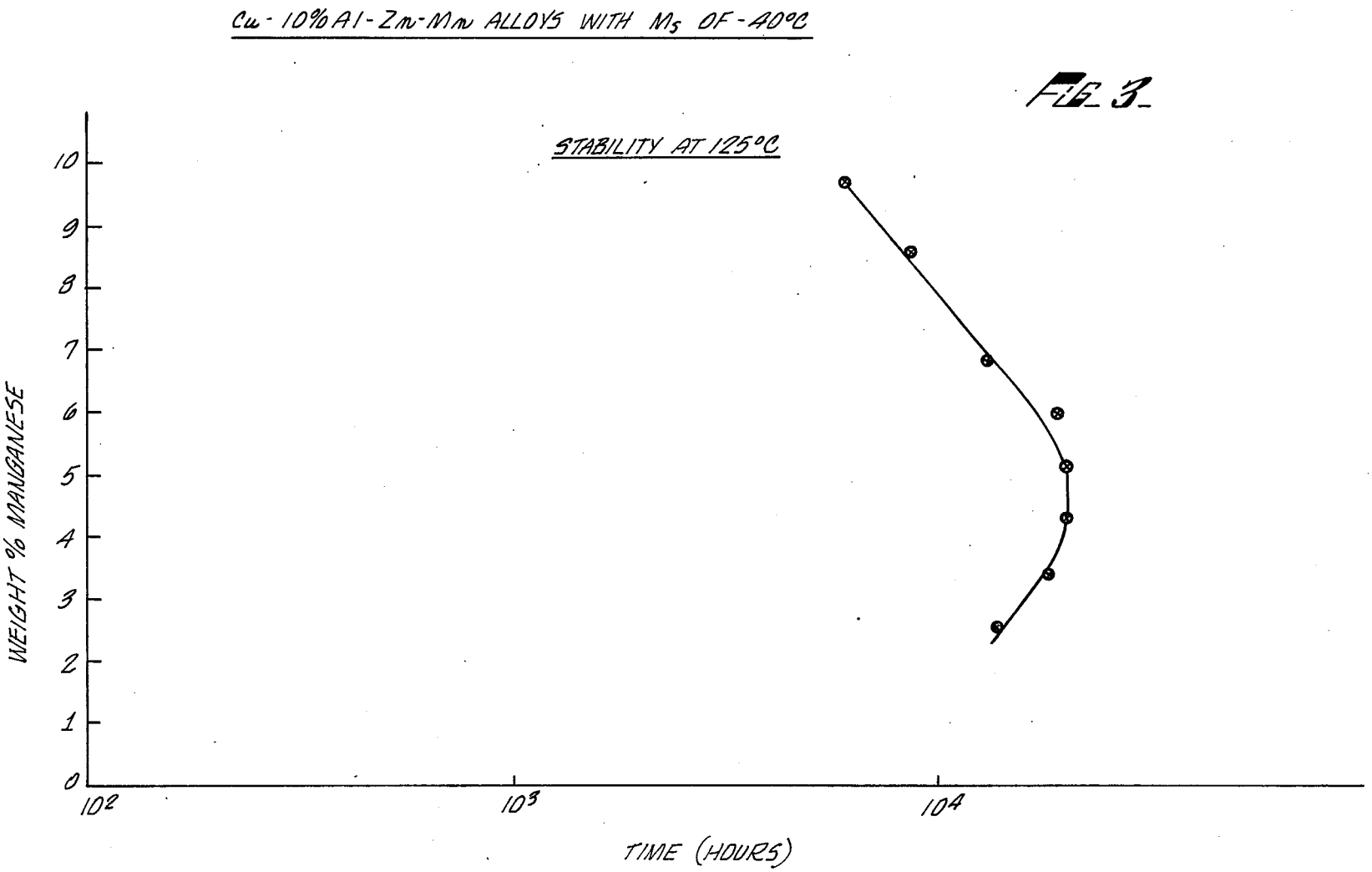
FIG. 3 is a graph showing the relationship between the eutectoid point and the long term stress stability of alloys of this invention.

The manner in which each of these factors affect the stress stability of these alloys can be seen from a consideration of FIGS. 3–6. Referring now to FIG. 3, there is shown the effect of varying the composition relative to the eutectoid for an alloy having an $M_s$ of $-40°$ C. and a constant aluminum content (10% by weight). The eutectoid composition contains 4.6% by weight of manganese.

Figure 4:
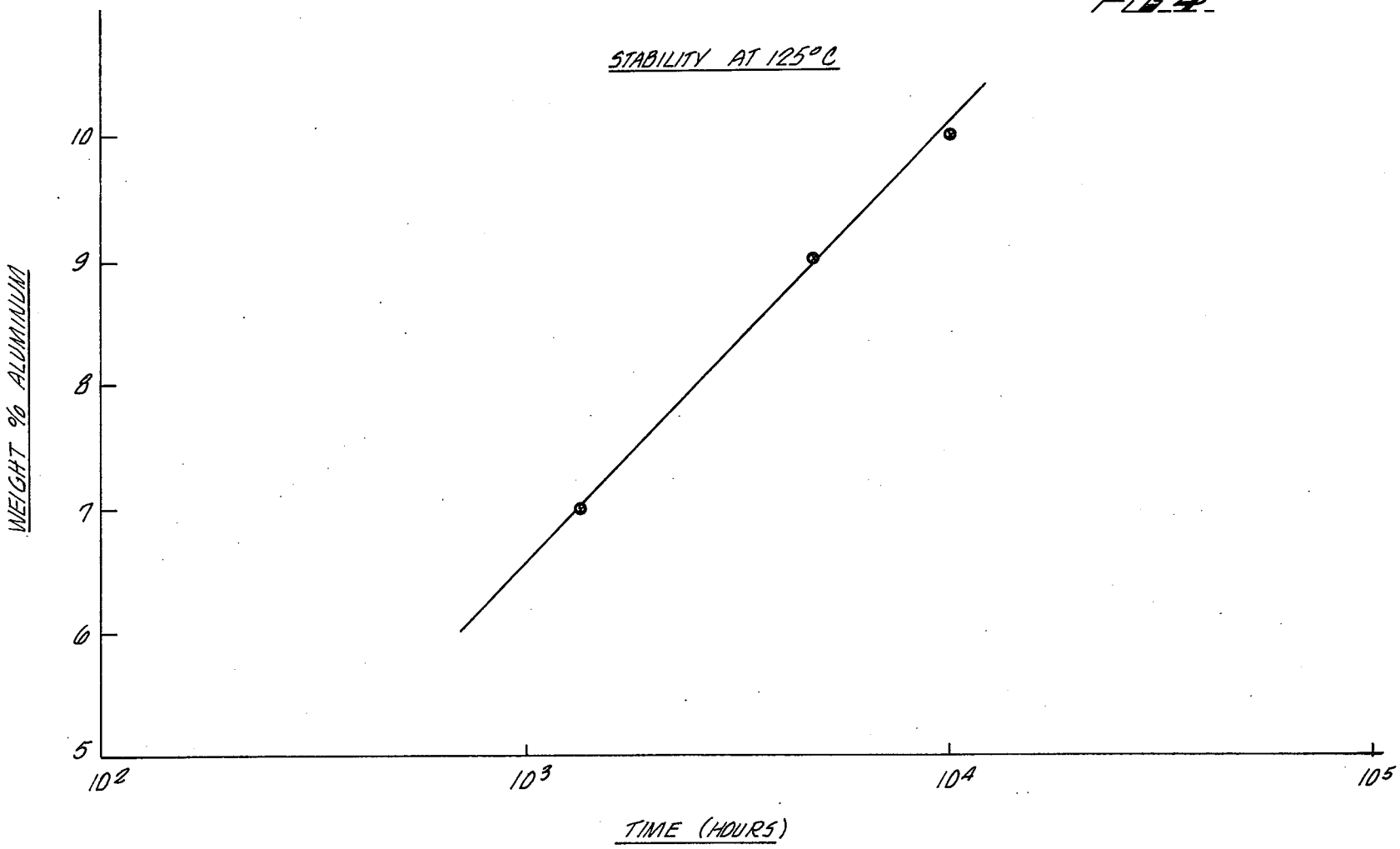
FIG. 4 is a graph showing the relationship between the aluminum content and the long term stress stability of the alloys of the present invention.

FIG. 4 illustrates the effect of increasing aluminum content for alloys all having an $M_s$ close to $-30°$ C. From FIG. 4 it can be seen that stress stability increases with the increase in aluminum content.

Figure 5:
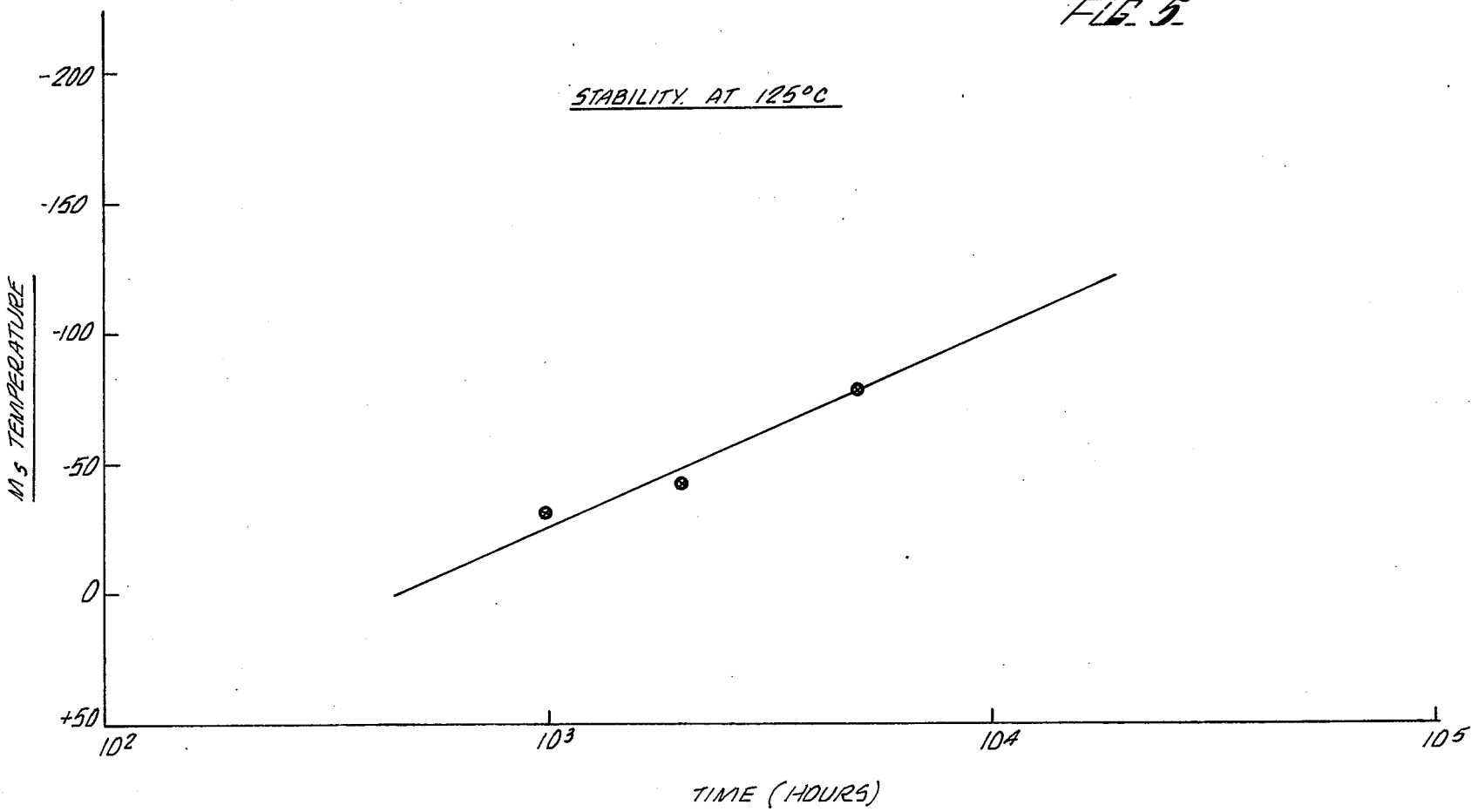
FIG. 5 is a graph showing the relationship between the $M_s$ temperature and the long term stress stability of the alloys of the present invention.

FIG. 5 shows the effect of varrying the $M_s$ temperature. The alloys used in the study for FIG. 5 all had the same aluminum content (10%). However, the relative proportions of the other elements were adjusted to obtain the desired $M_s$. From FIG. 5 it can be seen that alloys of lower $M_s$ are more stable. The experimental results used to deduce these conclusions are given in Table I.

Table I

| | Composition | | | | | |
|---|---|---|---|---|---|---|
| Alloy | Cu | Al | Zn | Mn | $M_s$ | Lifetime at 125° C. |
| 126 | 79.15 | 10 | 8.25 | 2.6 | −39 | 14,000 hours |
| 131 | 79.3 | 10 | 7.3 | 3.4 | −42 | 18,000 hours |
| 133 | 79.3 | 10 | 6.4 | 4.3 | −41 | 20,000 hours |
| 132 | 79.4 | 10 | 5.5 | 5.1 | −41 | 20,000 hours |
| 135 | 79.6 | 10 | 4.4 | 6.0 | −38 | 19,000 hours |
| 136 | 79.6 | 10 | 3.5 | 6.9 | −36 | 13,000 hours |
| 128 | 79.7 | 10 | 1.7 | 8.6 | −43 | 8,500 hours |
| 119 | 80.3 | 10 | 0 | 9.7 | −35 | 6,000 hours |
| 240 | 74.1 | 7 | 18 | 0.9 | −35 | 1,400 hours |
| 255 | 78.1 | 9 | 9.5 | 3.4 | −35 | 4,700 hours |
| 259 | 79.8 | 10 | 5.9 | 4.3 | −30 | 10,000 hours |
| 150 | 78.7 | 10 | 7 | 4.3 | −78 | 50,000 hours |

Figure 6:
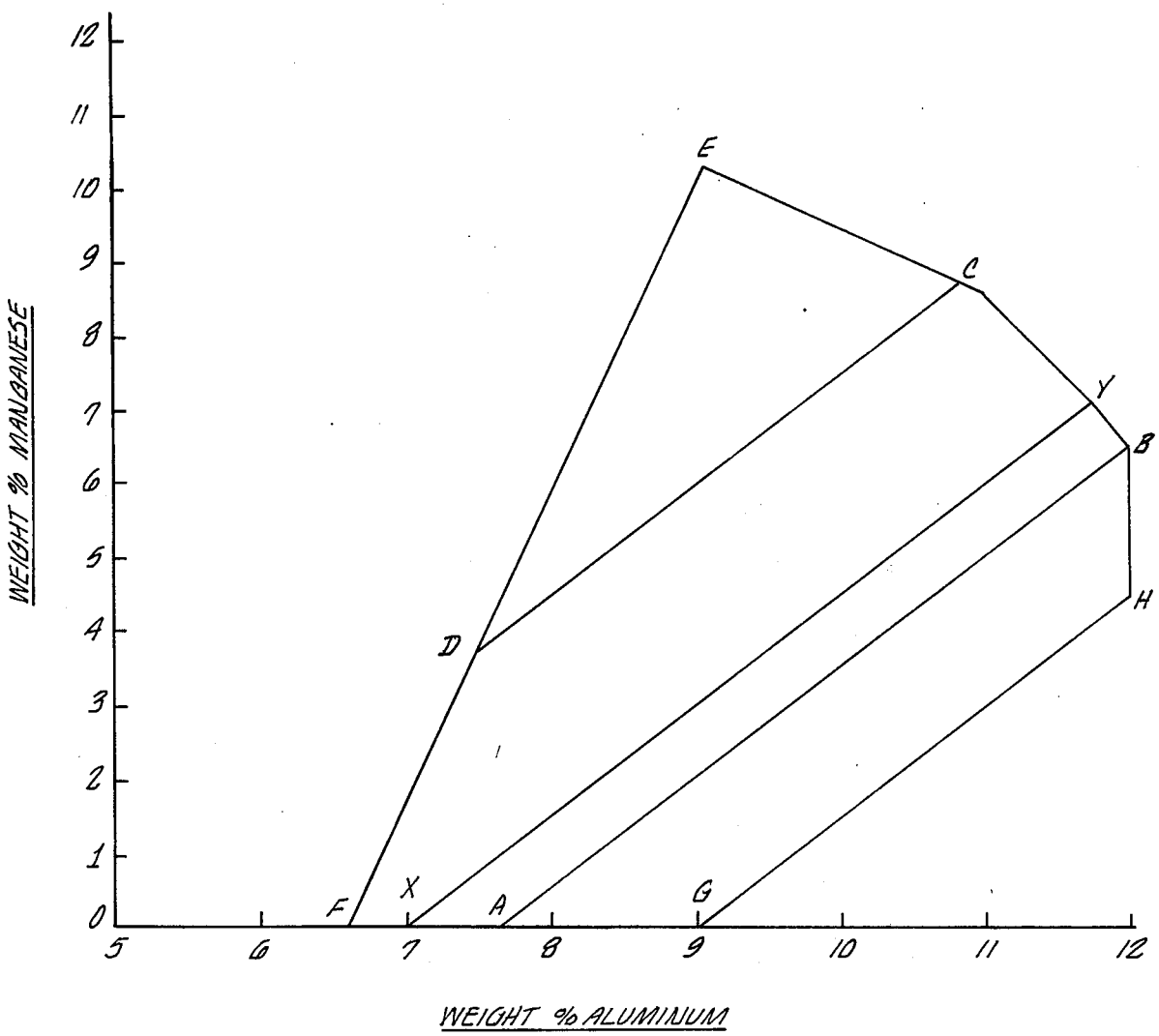
FIG. 6 is a graph showing the preferred compositional limits for alloys of the present invention having an $M_s$ temperature of −50° C.

In the practice of this invention, one selects an $M_s$ temperature that is convenient for the application to which an article is to be put. Then, from curves like those in FIGS. 3–5, the required levels of aluminum, manganese and zinc required for a desired life time can be estimated. It will be appreciated that for a given $M_s$, there is an associated large family of eutectoid compositions. Thus for any given $M_s$, the eutectoid line, as a function of Mn and Al content, is defined by the limiting ternary compositions of that $M_s$, i.e., the compositions where either the Mn and Zn content are respectively 0%. In the case of alloys having an $M_s$ of $-50°$ C., these alloys are Cu (81.05%), Al (11.75%), Mn (7.2%) and Zn (0%) and Cu (73.3%), Al (7%), Mn (0%) and Zn (19.2%). Referring now to FIG. 6, there is shown a graph of the line XY defined by the limiting ternary compositions described above. Thus, for all compositions on this line there is a coincidence between the eutectoid point and an $M_s$ of −50° C.

Similar lines can be obtained for alloys of $M_s$ other than −50° C. The following equation has been derived from which the line XY for other $M_s$ temperatures can be approximated:

$$\text{Mn(wt. \%)} = \left[1.78\ \text{Al(wt. \%)} - \left(\frac{790 + M_s}{59}\right)\right]\left(\frac{375 - M_s}{445 - M_s}\right) \quad \text{(a)}$$

The following equations have been derived to allow the estimation of the $M_s$ temperature for a variety of alloys after having been quenched from 650° C. into water at 20° C.

For alloys containing 6–10% and up to 4% Mn:

$$M_s\,(°\text{C}) = 2469 - 68\ \text{Zn(wt. \%)} - 172\ \text{Al(wt. \%)} - 89\ \text{Mn(wt. \%)} \quad \text{(b)}$$

For alloys containing 6–10% Al and 4–10% Mn:

$$M\,(°\text{C}) = 1844 - 52\ \text{Zn(wt. \%)} - 133\ \text{Al(wt. \%)} - 56\ \text{Mn(wt. \%)} \quad \text{(c)}$$

For alloys containing in excess of 10% Al:

$$M_s\,(°\text{C}) = 1787 - 57\ \text{Zn(wt. \%)} - 120\ \text{Al(wt. \%)} - 60\ \text{Mn(wt. \%)} \quad \text{(d)}$$

As previously indicated, the compositions of maximum stability for any given aluminum content lie at or near the eutectoid. In some instances it may be desired to operate on the gamma or alpha side of the eutectoid. In the case of the former, relatively limited deviation is permissable as on the gamma side precipitation of the gamma phase is difficult to avoid and the compositions containing this phase have a significant tendency to be less ductile. Generally good stability and suitable ductility can be achieved on the gamma rich side up to a 3% deviation in Mn content from that of the eutectoid. However, it is preferred to stay within about a 1% deviation in the Mn content.

Moving to the alpha rich side does not lead to a substantial reduction in ductility but does tend to cause a reduction in stability. The maximum level of manganese addition is controlled by the line EF. The composition of the two alloys E and F which are respectively ternary Cu-Al-Mn alloy and a ternary Cu-Al-Zn alloy are set forth in my two concurrently filed applications dealing with these two ternary systems. These limiting compositions are 73% Cu, 6.6% Al, 20.4% Zn and 80.6% Cu, 9.1% Al, and 10.3% Mn. Compositions with manganese levels in excess of that specified by the line EF will either have a stability of less than 1,000 hours at 125° C. or would require heating in excess of 650° C. to remove the α-phase. However, it is preferred to stay within about 3% by weight of the eutectoid on the alpha side for best results. The lines demarcating these bounds for alloys of $M_s = -50°$ C. are shown in FIG. 6 where line GH and AB, respectively show the 3% and 1% variance in manganese content on the gamma rich side of the eutectoid. By contrast, DC demarks the 3% variance in the manganese content and EF is the limiting level for high manganese content on the alpha side as explained above. Thus the highly preferred alloys of $M_s = -50°$ C. are found within the area bounded by the points ABYCDF.

For alloys of an $M_s$ other than −50° C., similar variance from the eutectoid also leads to alloys having an acceptable and even a highly desirable balance between stability and ductility. Graphs like that of FIG. 6 for alloys of an $M_s$ of other than −50° C. can be derived from equation (a) above for the eutectoid compositions. Line AB can be calculated from the following equation:

$$\text{Mn} = \left(1.78\ \text{Al} - \left[\frac{858 + M_s}{59}\right]\right)\left(\frac{375 - M_s}{445 - M_s}\right) \quad \text{(e)}$$

Line *CD* can be calculated from the equation:

$$\text{Mn} = \left(1.78\ \text{Al} - \left[\frac{586 + M_s}{59}\right]\right)\left(\frac{375 - M_s}{445 - M_s}\right) \quad \text{(f)}$$

Line *GH* can be calculated from the equation:

$$\text{Mn} = \left(1.78\ \text{Al} - \left[\frac{994 + M_s}{59}\right]\right)\left(\frac{375 - M_s}{445 - M_s}\right) \quad \text{(g)}$$

The alloys of the instant invention, possessing as they do outstanding combinations of properties as hereinbefore described, are useful in many and diverse applications. Thus, they may be used to provide hydraulic couplings and electronic connectors as described in U.S. Pat. No. 3,740,839 and copending, commonly assigned application Ser. No. 410,314 filed Oct. 29, 1973.

The unusually good hot workability of these alloys renders them particularly appropriate for use in extruded products. Thus they may be readily fabricated into wire, rod and various complex profiles. They may be readily stamped, swaged and formed by techniques well known to those skilled in the art.

Although in most applications it will be possible to furnish a desired article by hot working, in some applications it may be required to finish a fabricated object by cold working methods. In such instances it is advantageous to provide for the formation of some alpha phase after hot working but prior to the cold working processes. This can readily be achieved by using alloys from the Mn-rich side of the eutectoid.

I claim:

1. An alloy having a β-brass type structure capable of being rendered heat recoverable and capable of being cooled from a temperature at which it exists in an austenitic state to a temperature at which it exists in a martensitic state comprising 70–82% by weight copper, 6–12% by weight aluminum, 0.1–12% by weight manganese and 0.1–24% by weight zinc.

2. An alloy according to claim 1 which is heat recoverable.

3. An alloy according to claim 2 that when deformed from an original configuration while in its martensitic state and caused to partially recover towards said original configuration upon being warmed to the temperature at which the alloy reverts to its austenitic state exhibits stress stability of at least 1,000 hours at 125° C.

4. An alloy according to claim 3 which is heat recoverable.

5. An alloy according to claim 1, the components of which are present in an amount that corresponds to that for a eutectoid composition of copper, aluminum, manganese and zinc.

6. An alloy according to claim 5 which is heat recoverable.

7. An alloy according to claim 1 wherein the manganese content of the alloy deviates from the manganese content of the eutectoid composition by not more than about 3% by weight on the gamma-rich side of the eutectoid, said eutectoid being that of copper, aluminum, manganese and zinc.

8. An alloy according to claim 7 which is heat recoverable.

9. An alloy according to claim 7 wherein the manganese content of the alloy deviates from that of the eutectoid composition by not more than 1% by weight on the gamma-rich side of eutectoid.

10. An alloy according to claim 9 which is heat recoverable.

11. An alloy according to claim 1 wherein the manganese content of the alloy deviates from the manganese content of the eutectoid composition by not more than about 3% by weight on the alpha-rich side of the eutectoid, said eutectoid being that of copper, aluminum, manganese and zinc.

12. An alloy according to claim 11 which is heat recoverable.

13. An alloy according to claim 1 that when deformed from an original configuration while in its martensitic state and caused to partially recover towards said original configuration upon being warmed to the temperature at which the alloy reverts to its austenitic state exhibits stress stability of at least 1,000 hours at 125° C.

14. An alloy according to claim 13 which is heat recoverable.

15. An alloy according to claim 5 that when deformed from an original configuration while in its martensitic state and caused to partially recover towards said original configuration upon being warmed to the temperature at which the alloy reverts to its austenitic state exhibits stress stability of at least 1,000 hours at 125° C.

16. An alloy according to claim 15 which is heat recoverable.

* * * * *